US005941215A

United States Patent [19]

Augustin

[11] Patent Number: 5,941,215

[45] Date of Patent: Aug. 24, 1999

[54] FUEL INJECTION SYSTEM FOR A MULTICYLINDER INTERNAL COMBUSTION ENGINE

[75] Inventor: Ulrich Augustin, Kemen, Germany

[73] Assignee: Daimler-Benz AG, Stuttgart, Germany

[21] Appl. No.: 09/025,228

[22] Filed: Feb. 18, 1998

[30] Foreign Application Priority Data

Feb. 19, 1997 [DE] Germany ..... 197 06 467

[51] Int. Cl.[6] ..... F02M 37/04

[52] U.S. Cl. ..... 123/467; 123/458

[58] Field of Search ..... 123/467, 447, 123/458, 506, 446

[56] References Cited

U.S. PATENT DOCUMENTS

| | | | |
|---|---|---|---|
| 4,684,067 | 8/1987 | Cotter | 123/467 |
| 5,012,786 | 5/1991 | Voss | 123/467 |
| 5,109,822 | 5/1992 | Martin . | |
| 5,438,968 | 8/1995 | Johnson | 123/467 |
| 5,711,277 | 1/1998 | Fuseya | 123/467 |
| 5,711,279 | 1/1998 | Green | 123/467 |
| 5,713,326 | 2/1998 | Huber | 123/467 |

FOREIGN PATENT DOCUMENTS 196 12 38 10/1996 Germany .

*Primary Examiner*—Carl S. Miller
*Attorney, Agent, or Firm*—Klaus J. Bach

[57] ABSTRACT

In a fuel injection system for a multi-cylinder internal combustion engine with magnetic valve controlled direct injection fuel injectors of which each includes a housing having an injection nozzle with a nozzle needle biased into a closed position by a spring disposed in a spring chamber, and a magnetic valve controlled control piston having a valve structure at one end for controlling high pressure fuel admission to a fuel supply passage leading to the needle nozzle, the spring chamber is in communication with the fuel supply passage by a communication passage including a throttle structure permitting limited fuel flow to the spring chamber such that, upon failure of the injector resulting in a continuous pressurization of the fuel supply passage, the pressure in the spring chamber builds up to seat the nozzle needle thereby interrupting fuel ejection from the injector.

7 Claims, 3 Drawing Sheets

FUEL INJECTION SYSTEM FOR A MULTICYLINDER INTERNAL COMBUSTION ENGINE

BACKGROUND OF THE INVENTION

The invention relates to a common rail-type fuel injection system for a multi-cylinder internal combustion engine with magnetic valve controlled direct-injection fuel injection valves with a fuel admission passage leading in each valve housing to a spring-loaded nozzle needle and including a control piston with an integral control valve by which the fuel admission passage can be closed. The valve housing includes a spring space with a spring engaging the nozzle needle so as to bias it onto a nozzle needle seat. A control space is disposed on the backside of the control piston which is exposed to system pressure and, adjacent the control space, there is a cooperating magnetic valve by which the control space can be placed in communication with a pressure relief passage whereby, at the same time, the fuel supply passage leading to the nozzle needle can be opened, the fuel supply passage being also in communication with the pressure relief passage by way of a throttled communication passage.

DE 196 12 738 A1 discloses such a common rail injection system with magnetic valve controlled fuel injection valves. Each injection valve includes a control piston cooperating with a spring-loaded nozzle needle by way of the spring space delimited by the control piston. The spring space is in communication with a drain line of the fuel injection valve.

Upon malfunctioning of the injection valve either by a defect in the magnetic valve or jamming of the control piston, there is a permanent high pressure connection to the fuel injection nozzle which can lead to serious engine damage.

U.S. Pat. No. 5,109,827 discloses a common rail fuel injection system for a multi-cylinder internal combustion engine with magnetic valve controlled direct-injecting fuel injection valves which include throttling arrangements that do not provide for a closing of the needle valves when the injection valves are malfunctioning.

It is the object of the present invention to provide a fuel injection valve for a direct fuel injection system of the common rail type which includes means whereby, in a simple manner, engine damage by the fuel injection system becomeing defective is prevented but, nevertheless, emergency operation of the engine is still possible.

SUMMARY OF THE INVENTION

In a fuel injection system for a multi-cylinder internal combustion engine with magnetic valve controlled direct injection fuel injectors of which each includes a housing having an injection nozzle with a nozzle needle biased into a closed position by a spring disposed in a spring chamber, and a magnetic valve controlled control piston having a valve structure at one end for controlling high pressure fuel admission to a fuel supply passage leading to the needle nozzle, the spring chamber is in communication with the fuel supply passage by a communication passage including a throttle structure permitting limited fuel flow to the spring chamber such that, upon failure of the injector resulting in a continuous pressurization of the fuel supply passage, the pressure in the spring chamber builds up to seat the nozzle needle thereby interrupting fuel ejection from the injector.

With this simple measure, that is, by providing a communication passage to the spring chamber, it is made sure that the valve nozzle needle is seated and remains seated if there is no injection pause that is if the injection duration exceeds a predetermined period. The pressure in the spring chamber will then exceed the difference between system pressure and closing pressure and will hold the needle valve closed.

In accordance with the invention, fuel can be supplied to the spring chamber by way of a single throttling passage by way of which fuel pressure is also released. The throttling passage should be sized so as to provide for a maximum fuel injection amount under maximum fuel supply pressure, but also for the injection of a sufficient fuel amount when there is a relatively low fuel supply pressure.

In a preferred embodiment of the invention, the fuel admission to the spring chamber is therefore made dependent on the fuel supply pressure (rail pressure) by providing an additional throttled fuel supply passage which is active when the fuel supply pressure is relatively low.

The invention will become more readily apparent from the description of two embodiments thereof on the basis of the accompanying drawings.

DESCRIPTION OF PREFERRED EMBODIMENTS

Figure 1:
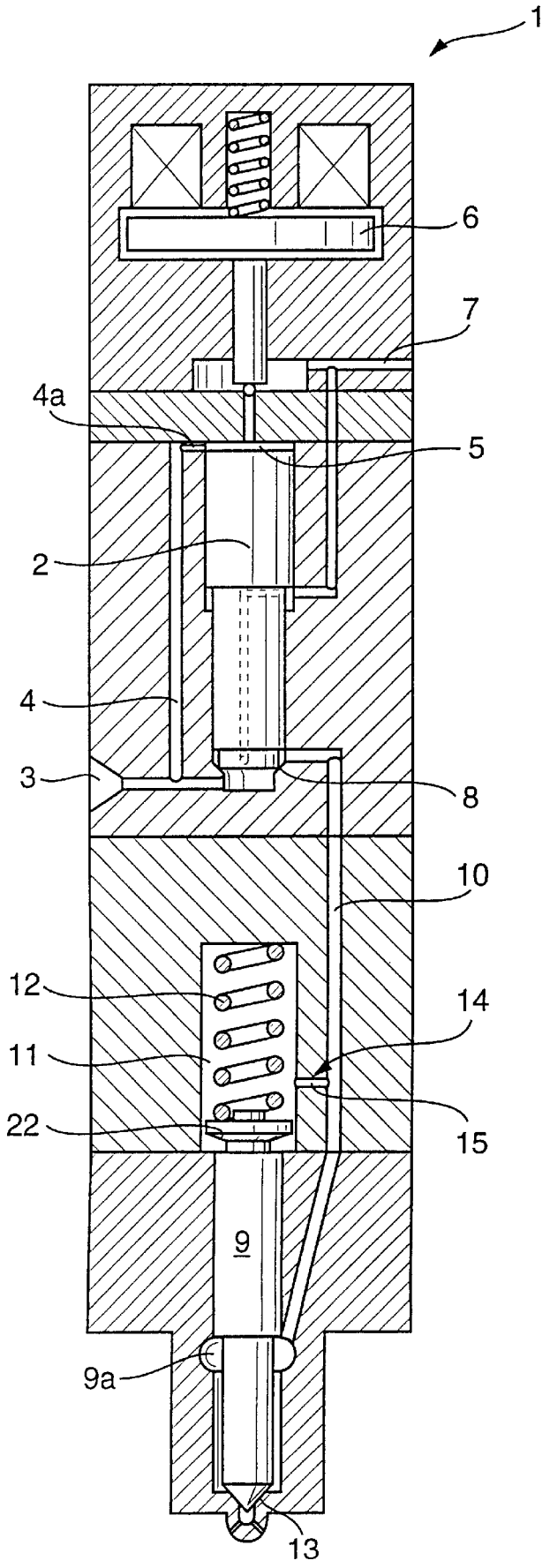
FIG. 1 shows a fuel injection valve with a throttling passage extending between the fuel supply passage leading to the fuel injection nozzle and the spring chamber.

The magnetic valve controlled direct injection fuel valve 1 (injector) for a common rail fuel injection system which is not shown in detail and which serves a multi-cylinder internal combustion engine comprises a control piston 2 to which a fuel supply line 3 leads for the supply of fuel under pressure thereto. A connecting passage 4 branches off the fuel supply line 3 and extends to a control chamber 5 on the backside of the piston 2 by way of a throttle 4*a*. The control chamber 5 delimited by the control piston 2 can be placed in communication with a drain line 7 by a magnetic valve 6.

The control piston 2 is subjected in the control chamber 5 to fuel system pressure and is firmly seated thereby on the valve seat 8 thereby blocking fuel flow, by way of a fuel supply passage 10, to a nozzle needle 9.

The nozzle needle 9 is biased onto its needle seat 13 by a nozzle needle spring 12 disposed in a spring chamber 11. The spring chamber 11 and the fuel supply passage 10 are in communication by a passage 14 extending therebetween. The passage 14 is smaller in diameter than the supply line 10 so as to act as a simple throttle structure 15.

Figure 2:
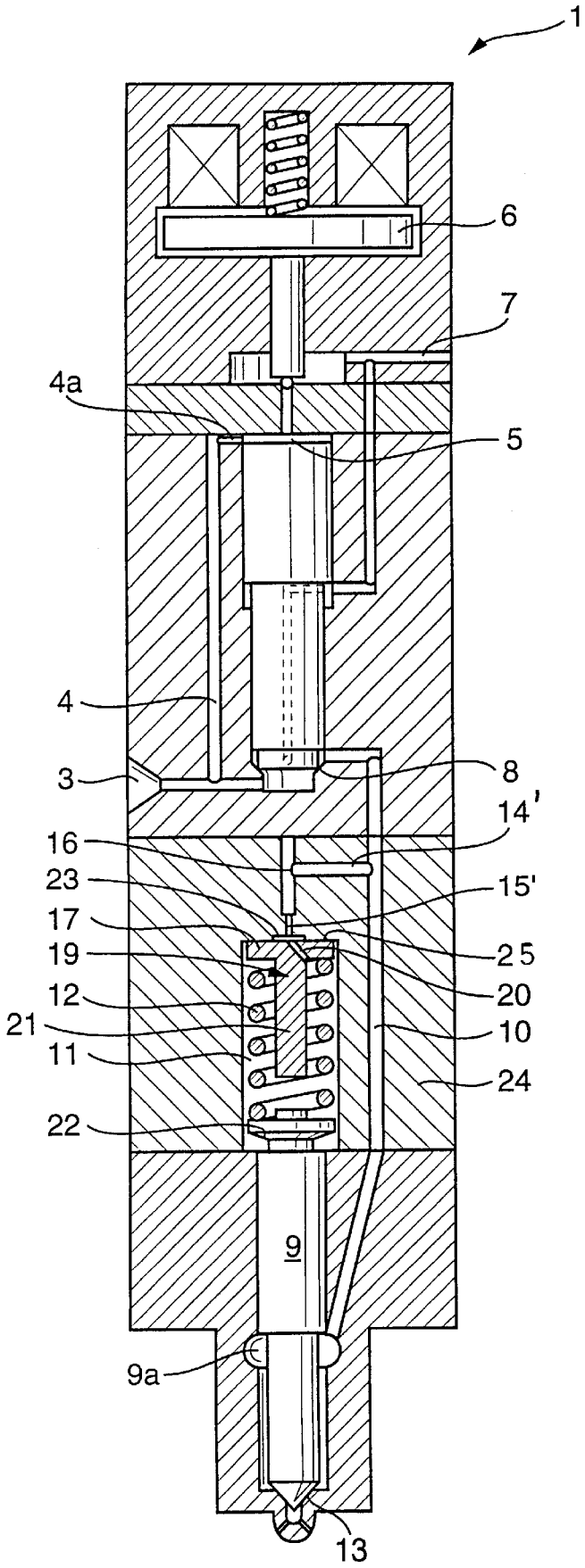
FIG. 2 shows another embodiment of the invention with a throttling arrangement including two throttling structures.

In the arrangement as shown in FIG. 2, the communication passage 14' is disposed above the spring chamber 11 and extends, angled downwardly by 90° to the center of the spring chamber 11. Most of the passage 14' has the same diameter as the fuel supply passage 10, but it includes a throttle portion 15' adjacent the spring chamber 11 and another throttle passage 20 with relatively small diameter. The throttle passage 20 is formed in a insert member 19 disposed in the spring chamber 11 where it is engaged by the spring 12 so as to be axially movable against the force of the spring 12. It forms a plate valve with a valve plate 17 disposed adjacent the throttle portion 15' and a valve shaft portion 21 extending into the spring 12. The spring 12 engages at one end the valve plate 17 and, at its other end, the valve needle 9. Between the throttle portion 15' and the throttle passage 20, there is provided a recess 23 which is formed either in the housing part 24 of the injector 1 or in the insert member 19 in order to provide for proper communication between the throttle portion 15' and the throttle passage 20.

Figure 3:
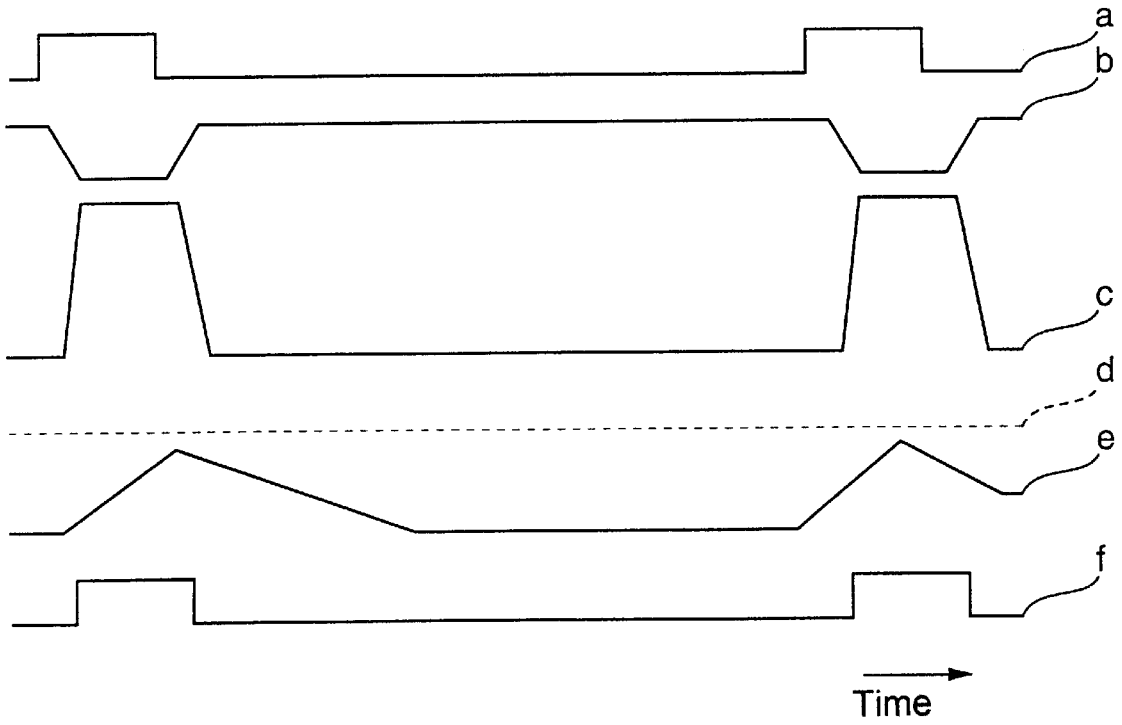
FIG. 3 shows graphs representing schematically pressure distribution, injector control and injector needle lift with a properly operating injector operating under full engine load conditions.

FIG. 3 shows the pressure curves, injector control and nozzle needle lift of the injector 1 as they are obtained with properly operating injector and full load fuel injection volume. The curve a indicates the control voltage for the magnetic valve 6 in a simple form which provides in the control chamber 3 above the control piston 2, for a pressure as it is indicated by the curve b and is known for common rail systems. By unseating of the control piston 2, a high pressure communication is established to the nozzle prechamber 9*a*, wherein a pressure is established as indicated by curve c. When the pressure in the prechamber 9*a* reaches the predetermined opening pressure the nozzle needle is lifted off the needle seat 13, the nozzle needle lift being indicated by the curve f.

During fuel injection, a pressure is built up in the spring chamber 11, which is generated, on one hand, by the displacement of the nozzle needle 9 and on the other hand, by the inflow of fluid by way of the throttle structure 15. The maximum pressure in the spring chamber 11 is below the pressure limit indicated by the dashed line d. Upon deenergization of the magnetic valve 6, the pressure b in the control chamber 5 increases whereby the control piston closes the valve 8 so that the communication between the high pressure fuel supply line 3 and the fuel supply line 10 is interrupted and the pressure effective on the nozzle needle 9 drops to the needle closing pressure and then, by leakage through a throttled communication passage to the drain line 7, to an even lower value. At the same time, fuel is released from the spring chamber 11 by way of the throttle structure 15 so that it is depressurized.

Figure 4:
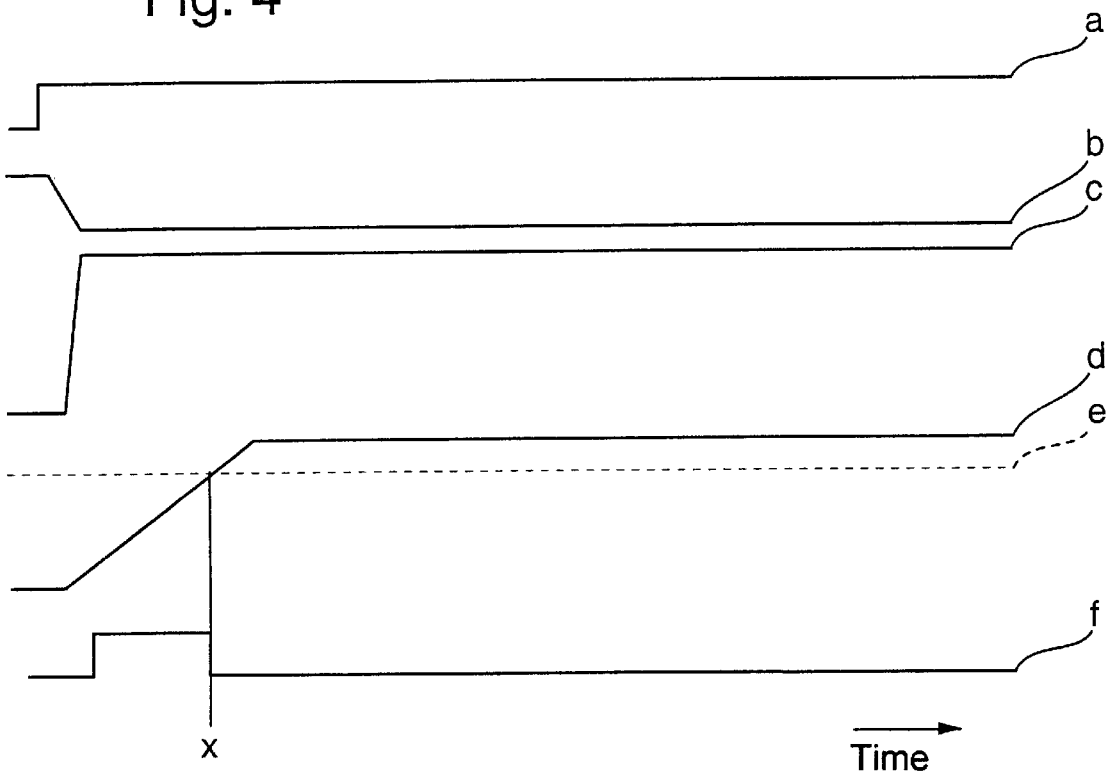
FIG. 4 shows the same graphs for a defective injector.

FIG. 4 shows the same curves as shown in FIG. 3, but for a defective valve 6, which does not close or wherein the control piston 2 is jammed so that constant high pressure is applied to the injector nozzle: In this case, the pressure in the spring chamber 11 will reach limit pressure c at the point in time x. The nozzle needle 9 is then exposed to system pressure at the pressure shoulder 9*a* and at the needle end and, on its backside in the spring chamber 11, it is subjected to the limit pressure c and the spring force of the nozzle needle spring 12.

This means that the nozzle needle now closes as soon as the pressure in the spring chamber 11 exceeds a value which corresponds to the difference between system pressure and closing pressure. This pressure is defined as limit pressure. The throttle structure 15 is so sized that, under all normal operating conditions, this limit pressure, with a safety distance, is never reached in the spring chamber 11.

With the embodiment as described with respect to FIG. 1, only a predetermined maximum fuel amount can be injected if the injection pause does not occur that is if the system is defective so that the engine cannot be damaged by excessive fuel injection.

To a certain degree, the system is self-compensating: with lower system pressures, the limit pressure is also lower and the pressure difference at the throttle structure 15 is lower so that the pressurization of the spring chamber 11 is delayed.

As described, the spring chamber 11 is pressurized and depressurized by way of a single throttle structure 15. If the throttle structure 15 were designed, that is, sized for the maximum fuel injection amount at maximum rail pressure, the fuel injection amounts at small rail pressures would be insufficient.

In order to still achieve an optimal arrangement for all rail pressure ranges, a comfort embodiment is provided according to FIG. 2. In this embodiment, the spring chamber 11 is filled with fuel by way of the passage 14' with a relatively large diameter throttle structure 15' and the relatively small diameter throttle passage 20 extending through the valve plate 17 of the insert member 19.

Then, with high rail pressures, the insert member 19 is lifted off its seat on the housing end wall 25 of the spring chamber 11. In this case, only the throttle structure 15' with the relatively large diameter is effective.

With low rail pressures, the insert member 19 remains seated so that the relatively small diameter throttle structure 20 is the effective throttling structure which provides for a relatively slow pressurization of the spring chamber 11. The pressure release from the spring chamber 11 is not time-critical as apparent from FIG. 3. It can occur in any case by way of the small diameter throttle structure 20.

Also this embodiment provides for a high operating safety if the magnetic valve 6 or the control piston 2 fail.

What is claimed is:

1. A common rail fuel injection system for a multi-cylinder internal combustion engine with magnetic valve-controlled direct-injection fuel injectors, each comprising an injector housing including an injection nozzle with a spring-loaded nozzle needle, a control piston with a valve structure formed at one end thereof for controlling high pressure fuel admission from a high pressure fuel supply to a fuel supply passage extending through said housing to said injection nozzle, a nozzle needle closing spring being disposed in a spring chamber and engaging said nozzle needle to resiliently hold said nozzle needle seated on a needle seat, said control piston having its other end exposed to the fuel pressure in a control chamber, which is in communication with said high pressure fuel supply by way of a throttle structure, a magnetic valve arranged adjacent said control chamber for controlling a communication path to a drain line for releasing pressurized full from said control chamber in order to establish communication between said high pressure fuel supply and said fuel supply passage for the ejection of fuel through said injection nozzle, said spring chamber being in communication with said fuel supply passage by a communication passage including a throttle structure permitting limited fuel flow to said spring chamber such that, upon failure of said injector resulting in a continuous pressurization of said fuel supply passage, the pressure in said spring chamber builds up to seat the nozzle needle thereby interrupting fuel ejection from said injector.

2. A fuel injection system according to claim 1, wherein said communication passage includes a single throttle structure effective for all fuel pressures.

3. A fuel injection system according to claim 1, wherein said communication passage includes a throttle structure of relatively large diameter effective with high fuel supply pressures and, arranged in series therewith, a throttle structure with a diameter smaller than the diameter of said relatively large diameter throttle structure which is effective with low fuel supply pressures.

4. A fuel injection system according to claim 3, wherein said small diameter throttle structure is formed in an insert member axially movably disposed in the spring chamber against the force of said spring.

5. A fuel injection system according to claim 3, wherein said insert member comprises a plate valve having a valve plate disposed adjacent said communication passage including said larger diameter nozzle structure and said smaller diameter nozzle structure is formed in said insert member so as to be in communication with said communication passage, said insert member being biased into sealing engagement with an end wall of said spring chamber such that, with small fuel pressures fuel flows from said fuel supply passage to said spring chamber through said smaller diameter throttle structure but, with high fuel supply pressures, said insert member is lifted from its seat on said spring chamber end wall so as to permit fuel flow into said spring chamber by-passing said smaller diameter throttle structure.

6. A fuel injection system according to claim 4, wherein said valve plate of said insert member includes a recess adjacent said communication passage by way of which said larger diameter nozzle structure is in communication with said smaller diameter nozzle structure.

7. A fuel injection system according to claim 5, wherein said insert member includes a shaft extending from said valve plate into said nozzle needle spring and said nozzle needle spring engages with one end said nozzle needle and with its other end the valve plate of said insert member.

* * * * *